US005322265A

United States Patent [19]

Keuck

[11] Patent Number: 5,322,265

[45] Date of Patent: Jun. 21, 1994

[54] TOWER LIFTING APPARATUS

[75] Inventor: Edwin L. Keuck, Lone Jack, Mo.

[73] Assignee: Communication Equipment Specialists, Inc., Lee's Summit, Mo.

[21] Appl. No.: 131,035

[22] Filed: Oct. 4, 1993

Related U.S. Application Data

[63] Continuation of Ser. No. 945,378, Sep. 16, 1992, abandoned.

[51] Int. Cl.[5] ..... B66F 7/12

[52] U.S. Cl. ..... 254/89 H; 254/89 R

[58] Field of Search ..... 254/89 H, 89 R, 105, 254/106, 108, 1, 30, 133; 52/745.01, 745.02, 745.03, 745.04

[56] References Cited

U.S. PATENT DOCUMENTS

| | | | |
|---|---|---|---|
| 1,999,174 | 4/1935 | Jackson | 254/30 |
| 2,645,454 | 7/1953 | Nourse | 254/30 |
| 3,096,076 | 7/1963 | Walli . | |
| 3,275,298 | 9/1966 | Hand | 254/89 H |
| 3,773,292 | 11/1973 | Thiermann | 254/30 |
| 4,251,974 | 2/1981 | Vanderklaauw . | |
| 4,256,286 | 3/1981 | Hudgins | 254/30 |
| 4,358,087 | 11/1982 | Sime | 254/89 H |
| 4,475,714 | 10/1984 | Heiskell et al. . | |
| 4,807,851 | 2/1989 | De Castro . | |
| 4,930,750 | 6/1990 | De Castro . | |
| 5,009,394 | 4/1991 | Marshall | 254/30 |
| 5,022,632 | 6/1991 | Beideck | 254/30 |

*Primary Examiner*—Robert C. Watson

*Attorney, Agent, or Firm*—Litman, McMahon & Brown

[57] ABSTRACT

An elongate tower lifting apparatus including clamps for frictionally clamping to each leg of a tower, jacks for operably engaging and lifting the clamps and a jack control system for controlling the lifting and lowering of the tower. The clamps are connected by cross braces and include structure to snugly and nestingly engage a tower leg. A method is described using the lifting apparatus to lift a tower subsequent to loosening a nut restraining each tower leg to allow placement of a cushioning pad between a foot of each tower leg and a supporting concrete platform.

12 Claims, 3 Drawing Sheets

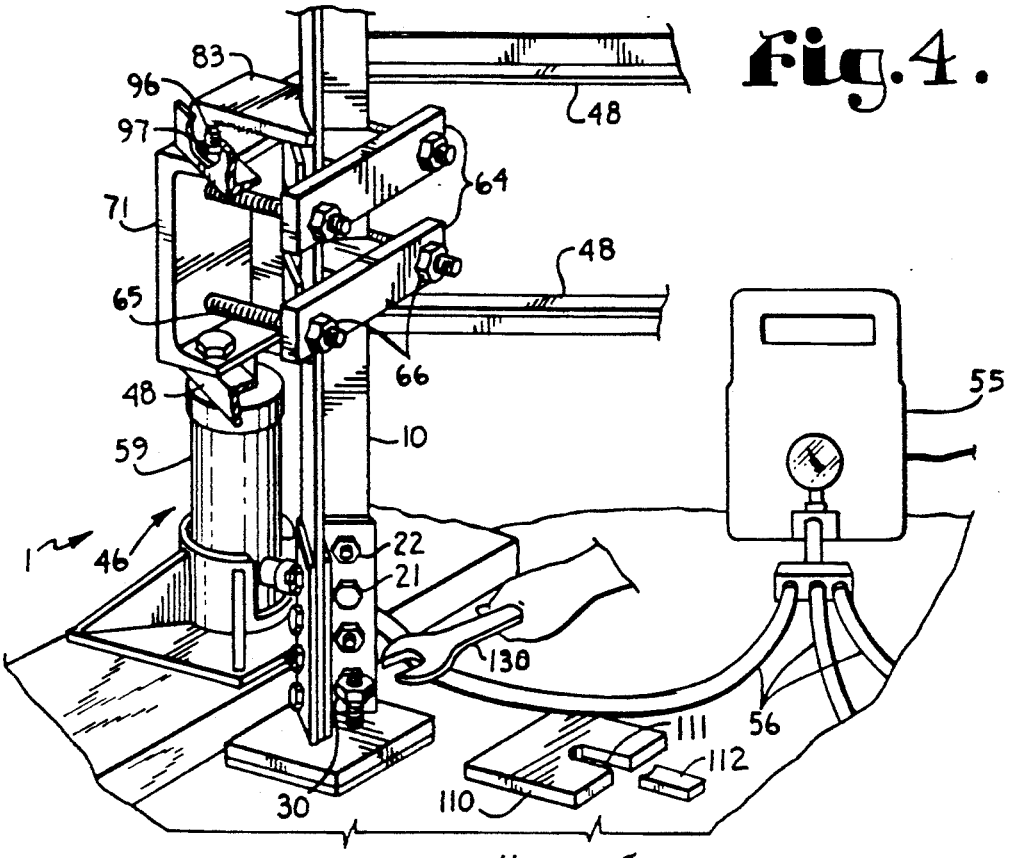
Fig. 4.
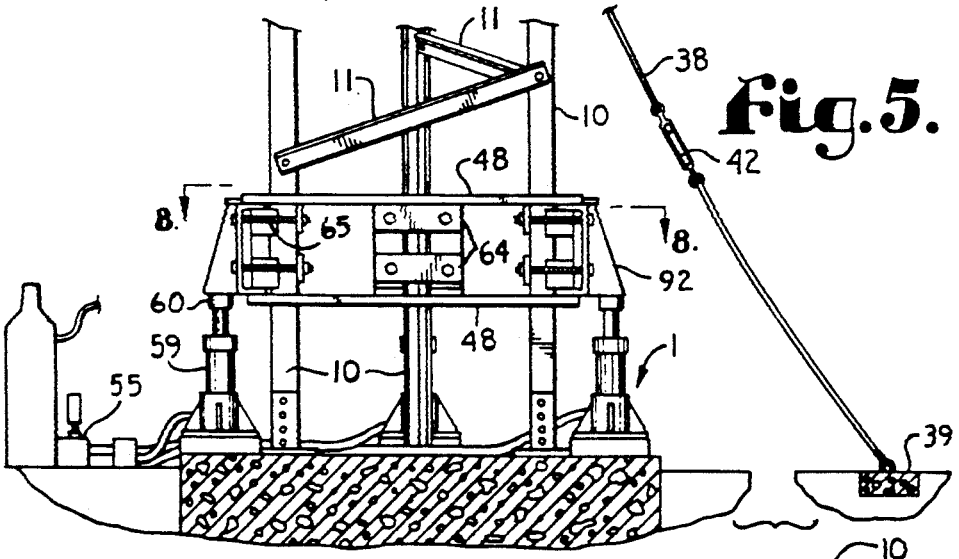
Fig. 5.
Fig. 6.
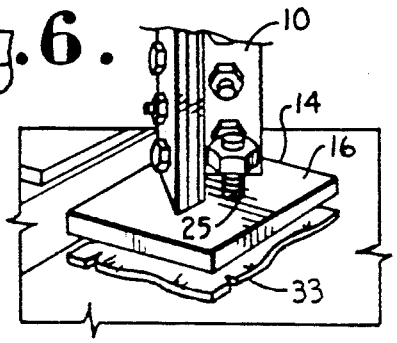
Fig. 7.
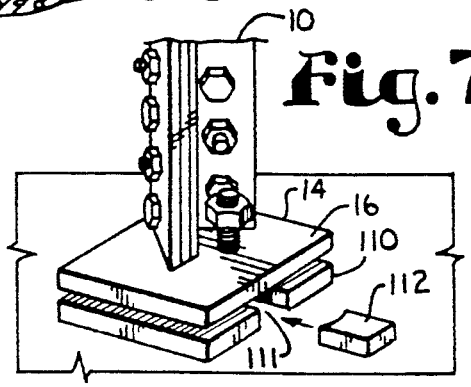

TOWER LIFTING APPARATUS

BACKGROUND OF THE INVENTION

This application is a continuation of Ser. No. 07/945,378 filed Sep. 16, 1992, now abandoned.

The present invention is directed to an apparatus and method utilized in lifting elongate communication towers and the like above concrete bases thereof so that cushioning pads for the towers can be inserted or replaced.

Free standing towers are quite often used where certain types of communications equipment require emission or reception of a signal from a elevated location relative to the surrounding land. Such towers are used for microwave relay stations, TV transmission, radio transmission and the like. The towers are normally very elongate and rest upon a concrete slab or base to which the bottom of the tower is normally bolted. The tower is also supported or secured in place against winds by multiple guy wires which are connected at various space locations along the tower and to anchor in the ground normally at various circumferentially spaced positions relative to the tower. Large towers of this type have a substantial weight associated therewith and do sway or rock as the wind changes speed or direction.

At the base or foot of the tower the metal of the tower rocks directly on the concrete slab during wind changes, if there is not some type of protective cushion therebetween. The metal of the tower slowly pulverizes or digs into the surface of the concrete and eventually seriously damages the concrete slab.

Consequently, a cushion is normally placed between the tower and the concrete slab to absorb the rocking motion of the tower and help prevent damage to the slab. Such cushions are normally made of a tough polymeric material and they will absorb a substantial amount of the rocking motion of the tower over a period of time and, therefore, prevent damage to the concrete. However, these pads do eventually wear and must be replaced in order to prevent eventual damage to the concrete slab.

Historically, replacement of these cushioning pads has been an expensive, lengthy and potentially dangerous procedure. Often one or more cranes, as needed for the particular tower, are utilized to raise the tower a sufficient amount to remove the old pads and insert new pads. Such an activity requires the bringing to the tower site one or more very large cranes. It is also difficult to fully stabilize the tower while the cranes are raising the tower which requires that the procedure be extremely slow and handled very carefully in order to avoid upsetting the tower, injuring workers at the site or even moving the lower base slightly laterally so that it will not align with bolts in the concrete slab. Small movements at the base of the tower are especially difficult to control since the cranes are normally attached to a location substantially vertically spaced above the ground. Consequently, procedures of this type sometimes take many days and are quite expensive.

It is applicant's understanding that one other process has also been utilized to raise towers, but applicant has not been able to verify such a process, nor has applicant ever seen such a process. It is understood that in this process that possibly throughbores are drilled in the legs of the tower and bolts inserted in these throughbores are used to attach structure including hydraulic jacks to the tower legs. If such throughbores are drilled in the tower legs, this potentially weakens the leg of the tower. If throughbores are utilized that are already existent in the tower, they are normally either near ground level or elevated 20 feet above the base at the first junction of the metal members of the legs. In such a situation the raising of the tower would require that a trench be dug around the tower if the lower throughbores were used or a substantial scaffold would have to be built that would be able to support the tower if the upper throughbores were used, both of which would take a substantial amount of time and equipment which would add dramatically to the cost of the operation.

Consequently, it is desirable to have a method of lifting a tower for replacement of cushioning pads that quickly, safely and economically raises the tower sufficiently to allow replacement of the pads while not significantly weakening or damaging the structure of the tower or requiring the construction of a temporary support platform.

SUMMARY OF THE INVENTION

An apparatus is provided for mechanically lifting, preferably with hydraulic equipment, an elongate tower so that repair work such as the replacement of cushioning pads between the tower and a concrete pedestal or base thereof can be replaced. The apparatus comprises a clamping mechanism which clamps onto each of the legs of a tower without substantially distorting the legs or requiring drilling or other significant modification to the legs.

The clamps preferably include a pair of members which are designed to abut against opposite sides of the legs and be snugged thereagainst by connecting bolts or the like. The clamp members frictionally engage the leg. The apparatus also includes a hydraulic system having hydraulic jacks which are placed so as to be supported by the concrete platform or the like and engage cooperating structure of the clamps. Stabilizing bars are also utilized to join the clamps together to help stabilize the tower during lifting. A hydraulic pump mechanism is utilized to raise and lower the hydraulic jacks as required.

A method of use of the apparatus in lifting the tower includes clamping one of the clamps to each of the tower legs at approximately the lowered height of the hydraulic jacks and then joining the stabilizing bars. One of the hydraulic jacks is then placed under each of the clamps and connected to a hydraulic fluid pump with a suitable control mechanism. Nuts which normally help secure a foot of each leg of the tower to the concrete platform are loosened several inches.

Guy wires may be slackened slightly if necessary to allow the tower to be raised. The hydraulic system is then actuated to raise pistons of the hydraulic jacks beneath the clamps, and consequently, to raise the tower in a controlled manner a sufficient amount to allow the insertion of a new pad. Old pads and other debris are normally cleared from beneath the foot of each leg prior to insertion of the new pad. Subsequent to insertion of the new pad, the process is reversed and the tower is lowered. The nuts holding the tower feet to the concrete base are retightened and the guy wires are again tightened if they were loosened. Thereafter, the tower lifting apparatus is removed.

OBJECTS AND ADVANTAGES OF THE INVENTION

Therefore, the objects of the present invention are: to provide an apparatus for raising elongate towers to replace cushioning pads thereof or to complete other required maintenance; to provide such an apparatus which is easily transported and which can be easily and quickly connected to a tower to be raised; to provide such an apparatus which does not require the boring of holes or other significant modifications to the legs of a tower to be raised and does not require other harmful procedures to the tower to be used in conjunction with the raising of the tower; to provide such an apparatus which does not significantly damage or weaken the structural integrity of a tower to be raised; to provide a method of raising a tower utilizing a hydraulic jack system which is frictionally connected to the tower and which does not significantly weaken or structurally damage the tower; to provide a method and apparatus for raising a tower which are easy to use, inexpensive to operate and especially well suited for the intended purpose thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is an enlarged and fragmentary perspective view of the tower leg as seen in FIG. 3 with the tower lifting apparatus engaging the tower leg in a lowered position and illustrating the loosening of a nut holding the tower leg to base.

FIG. 5 is an enlarged and fragmentary front view of the tower with the tower lifting apparatus positioned in the lowered position ready to raise the tower.

FIG. 6 is an enlarged and fragmentary perspective view of the leg of the tower seen in FIG. 4 but in a raised position with the leg raised approximately one to two inches to allow removal of an old cushioning pad thereunder.

FIG. 7 is an enlarged and fragmentary perspective view of the tower leg seen in FIG. 4 in the raised position and subsequent to the insertion of a new cushioning pad beneath the foot of the tower leg.

DETAILED DESCRIPTION OF THE INVENTION

Figure 1:
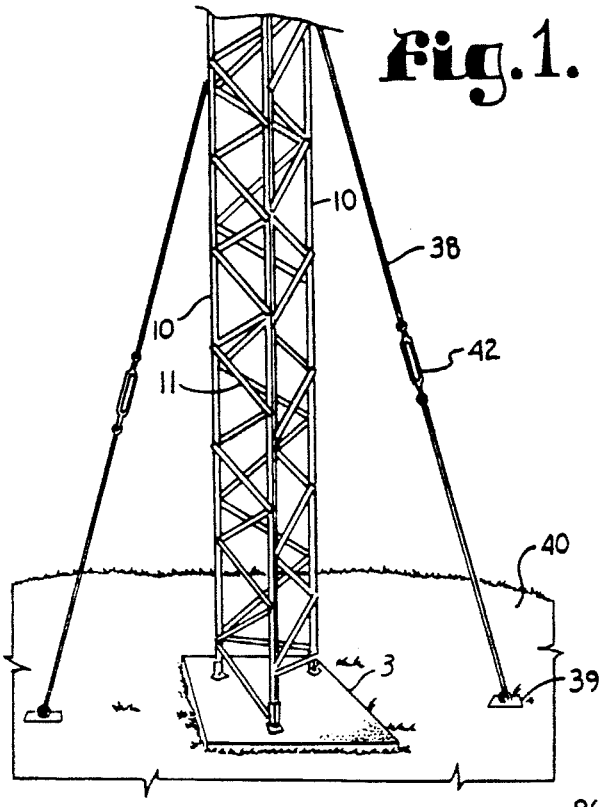
FIG. 1 is a fragmented perspective view of an elongate tower resting upon a concrete base prior to raising.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally represents a tower lifting apparatus in accordance with the present invention shown in conjunction with a tower 2 and a concrete support base or platform for the tower 3.

The tower 2 is an elongate type of tower of metallic construction utilized to support various types of electronic communications equipment and the like, such as TV and radio towers and microwave transmission relay towers. The tower 2, that is illustrated in FIG. 1 generally comprises three elongate legs 10 connected by multiple cross braces 11. The legs 10 are arranged in a triangular fashion, although towers having more than three legs or towers having legs arranged in different geometrical configurations can be lifted utilizing the present invention. Each of the legs 10 is generally V-shaped in configuration, as is seen in FIG. 2, and is constructed usually of multiple segments joined together at various lengths such as at every 20 feet.

Figure 2:
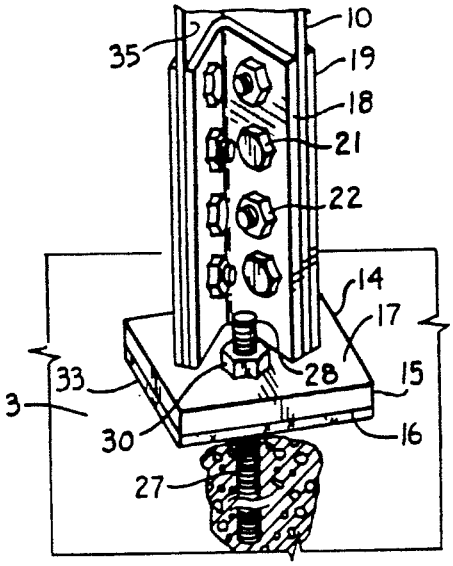
FIG. 2 is an enlarged and fragmentary view of a leg of the tower showing a foot of the tower leg resting upon the concrete base with portions broken away to show detail thereof.

Also, as seen in FIG. 2, each leg 10 includes a foot 14 attached to the bottom thereof. Each foot 14 generally includes a rectangular metallic plate 15 which is generally positioned so as to lie relatively flat with respect to the base 3. An underside 16 of each plate 15 faces the base 3 and an upper side 17 joins with the remaining leg 10 of the tower 1. The foot 14 may be welded to remainder of t he leg 10 or, as is shown in the present embodiment, the plate 15 is fixedly welded to a pair of strengthening structural members 18 and 19 which are approximately the same width and shape as an associated leg 10 supported by the foot 14. Each of the structural members 18 and 19 is nested on opposite sides of the associated leg 10 so as to abut against the leg 10. Multiple throughbores (not shown) are drilled through the structural members and the associated leg 10 so that the two associated structural members 18 and 19 and leg 10 may be secured together by a plurality of bolts 21 and nuts 22. Each of the plates 15 has a vertical bore 25 extending therethrough.

The base 3 is generally constructed of concrete or similar material and shaped, sized and constructed so as to be suitable for functionally supporting the tower 1. Deeply embedded in the concrete base 3 are three elongate bolts or rods 27 which extend vertically. An upper end 28 of each of the rods extends above the base 3 and is threaded. The upper end 28 of each of the rods 27 passes through a respective bore 25 and one of the tower feet plates 15. A nut 30 is utilized to secure a respective rod 27 to a foot 14.

If the lower surface 16 of each foot 14 is allowed to rest directly upon an upper surface 32 of the base 3, the foot 14 will tend to abrade, pulverize or otherwise damage a base surface 32 due to rocking motion of the tower, caused by wind and the like. Consequently, a cushioning pad 33 having approximately the same horizontal dimensions as the plate bottom 16 is positioned between each foot 14 and the base 3.

In the present embodiment the platform legs 10 are V-shaped and have an inner surface 35 and an outer surface 36. However, it is foreseen that legs having other configurations could be utilized in conjunction with the apparatus of the present invention with suitable modifications to the apparatus 1 to adjust for the change in size or shape of the legs 10. It is also noted that the tower 2 is generally supported against swaying by a plurality of guy wires 38 which typically connect vertically spaced positions along the tower 2 and anchors 39 mounted in the ground 40 surrounding the tower 2. Each of the guy wires 38 includes a turn buckle 42 or the like therealong for adjusting the tension associated with each guy wire 38.

The tower lifting apparatus 1 generally comprises jacking means such as a hydraulic jacking system 46, a plurality of clamps 47 adapted to each be securely and frictionally connected to a respective tower leg 10 and a plurality of cross braces 48 connecting between the clamps 47.

The jacking system 46 includes a hydraulic jack 54 for each of the tower legs 10, a hydraulic pump and control apparatus 55 and connection hoses 56 connecting the jacks 54 with the control apparatus 55. Each of the jacks 54 includes a base 58, a fluid cylinder 59 and a piston 60. The base 58 is designed to provide support for the cylinder 59 and piston 60 so that the motion of the piston 60 is along a vertical axis when in use.

Figure 3:
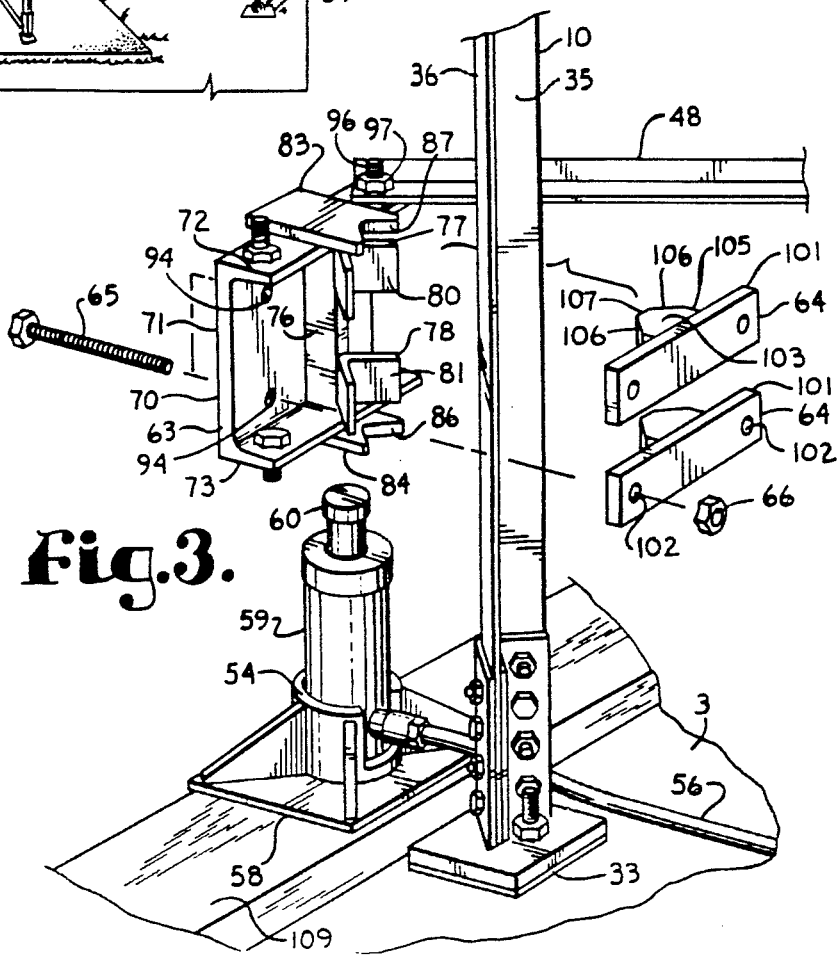
FIG. 3 is an enlarged and fragmentary perspective view of a leg of the tower in conjunction with an exploded view of portions of a tower lifting apparatus in accordance with the present invention.

One of the clamps 47 is provided for each of the tower legs 10 and is shown in an exploded view in FIG. 3 as well as attached to a respective tower leg 10 in FIG. 4. Each of the clamps 47 include a support and bracing plate member 63, a pair of straps 64 and four bolts 65 with nuts 66 to secure the straps 64 to the backing plate member 63.

Each of the backing plate members 63, as are best illustrated in FIGS. 3, 8, 9 and 10 include a channel 70 with a vertically aligned web 71 connecting two opposed and horizontally positioned flanges 72 and 73. Extending vertically between the two flanges 72 and 73 medially along the side of the channel 70 facing the leg 10 and welded thereto is a rectangular brace 76. Welded to the leg facing side of each brace 76 and vertically spaced therealong are a pair of V-shaped members 77 and 78 that are secured to the brace 76 at the apexes thereof. The V-shaped members 77 and 78 have interior surfaces 80 and 81 respectively that are sized and shaped so as to snugly receive the outer surface 36 of a respective leg 10.

Figure 9:
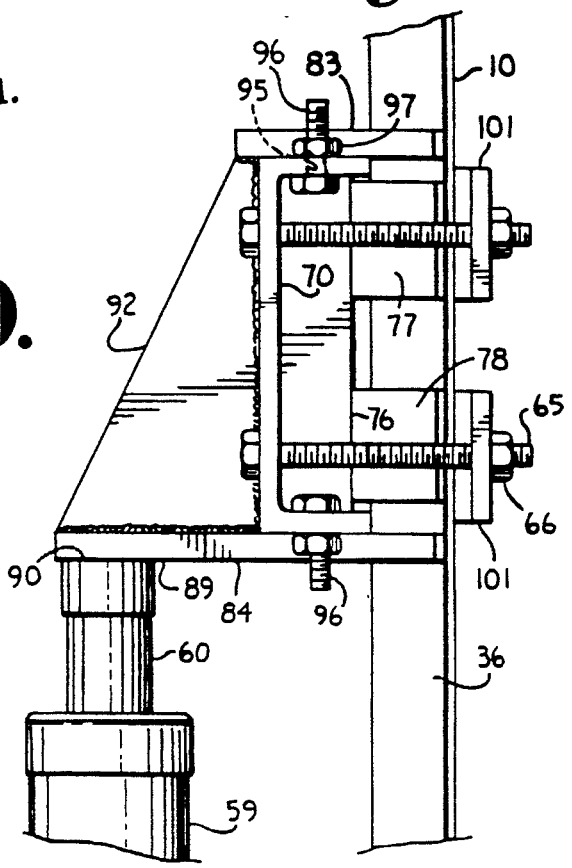
FIG. 9 is an enlarged and fragmentary front elevational view of a leg of the tower and of the tower lifting apparatus in the raised position showing a lifting apparatus clamp frictionally joined to one leg of the tower and being supported by a hydraulic jack.

A pair of elongate somewhat rectangularly shaped strengthening and positioning supports 83 and 84 are secured by welding or the like to the top and bottom of the channel 70 so as to be attached to the flanges 72 and 73 respectively and to extend outwardly on either side thereof. The bottom support 84 extends rearwardly of the channel 70 further than the upper support 83. The front ends of each of the supports 83 and 84 are V-shaped so as to have V-shaped surfaces 86 and 87 which are also sized and shaped so as to snugly and evenly receive the outer surface 36 of a respective leg 10. As is seen in FIG. 9 the lower side 89 of the support 84 abuts against the upper surface 90 of a respective jack piston 60 during use. A substantially triangularly shaped member or gusset 92 having a slightly upward truncated portion is welded to each of the supports 83 and 84 and to the rear side of the channel 70 so as to extend generally vertically and to help prevent bending of the support 84 when pressure is applied thereto by a respective jack 54.

Figure 8:
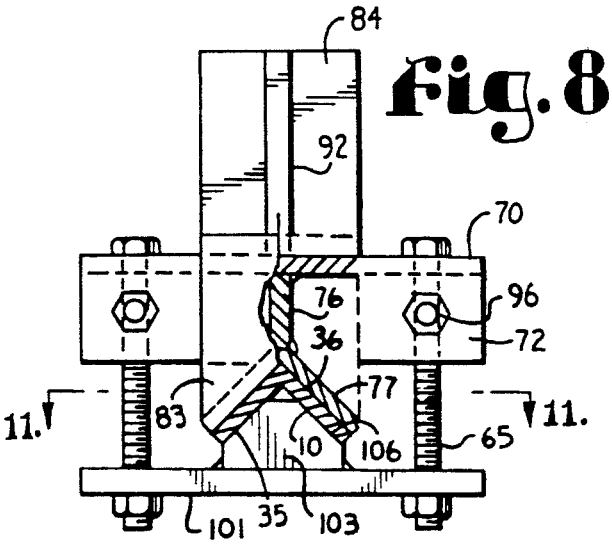
FIG. 8 is an enlarged and fragmentary cross sectional view of the tower taken along line 8—8 of FIG. 5.
Figure 10:
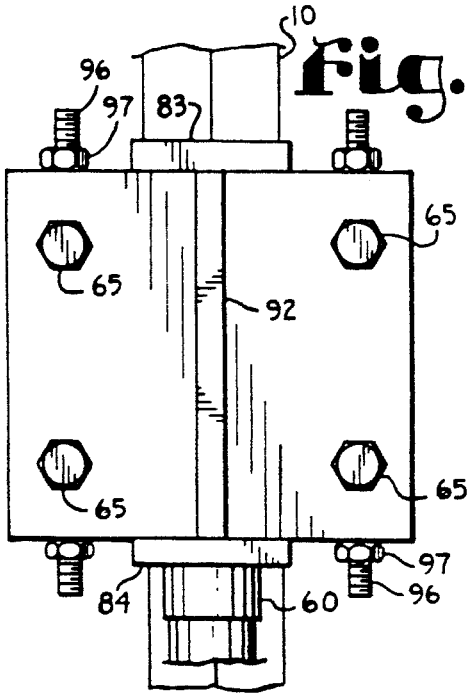
FIG. 10 is a fragmentary and enlarged side elevational view of one of the tower lifting apparatus clamps, as seen in FIG. 9, connected to a leg of the tower.

Four generally equally spaced apertures 94 extend generally horizontally through the channel 70 to receive the bolts 65. Likewise, four generally vertically aligned apertures 95 are positioned in opposite corners of the plate member flanges 72 and 73 so as to each receive a bolt 96 held in place by a locking nut 97. When fully assembled, as in FIG. 1, one of the cross braces 48 is secured to each bolt 96 by a nut 98. In this manner a pair of cross braces 48 extend from each side of the top and bottom of each clamp 47 to an adjacent clamp 47. FIGS. 8, 9 and 10 show the clamps 47 only partially completed without cross braces 48 which are shown in FIGS. 4 and 5.

Figure 11:
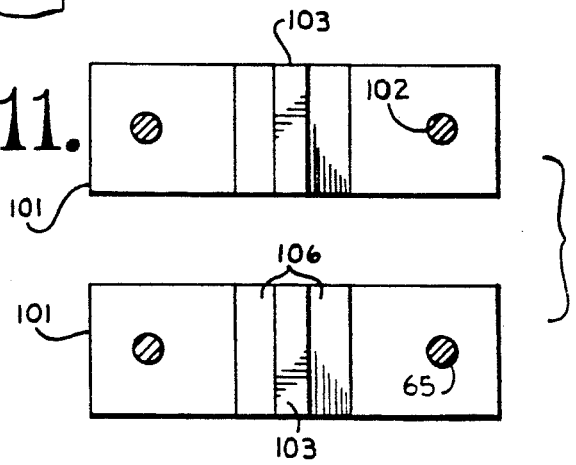
FIG. 11 is an enlarged and fragmentary cross sectional view of a portion of the tower lifting apparatus clamp seen in FIG. 9 taken along line 11—11 of FIG. 8.

Each of the straps 64, (see especially FIGS. 8 and 11) extending generally horizontally therethrough to receive one of the bolts 65. Mounted on each plate 101 is a lug 103 having a somewhat six sided cross section when viewed from above. The largest side of the lug 103 is secured onto a respective plate 101. Extending outwardly from the plate 101 are a pair of sides 105 joined to a pair of converging sides 106 which are shaped and sized so as to be snugly received within the inner surface 35 of a tower leg 10. The sixth surface 107 defines generally a truncated shape of what would otherwise be received within the tower leg inner surface 35 such that the surfaces 106 can be snugged tightly against the inner surface 35 by the bolts 65.

In use, and in conjunction with a method of use of the apparatus 1, the apparatus 1 is first assembled upon a tower 2 to be raised, as is shown in FIGS. 4 and 5. This assembly occurs as is shown in FIG. 3 where the clamp backing plate member 63 is secured to associated straps 64 by bolts 65. Upon snugging down of the nuts 66 of the bolts 65, the backing plate member 63 and straps 64 are urged toward one another and snugly against the outer surface 36 and inner surface 37 respectively of a tower leg 10 to which the clamp 47 is being attached. The V-shaped member surfaces 80 and 81 of the backing plate member 63 snugly, abratingly and frictionally engage the rear surface 36 of the tower leg, while the surfaces 106 of the strap lugs 103 snugly, abratingly and frictionally engage the inner surface 35 of an associated tower leg 10.

In this manner each clamp 47 is joined to a tower leg 10 and held in place therealong by friction without substantially distorting the leg 10, requiring boring or causing other damage to the tower leg 10. Once the clamps 47 are securely attached to the legs 10, the cross braces 48 are attached to and between the clamps 47.

A jack 54 is also positioned under each support plate 84 of each clamp 47 during the installation process and a plank 109 or other suitable structure may be positioned between the jack 54 and the concrete platform 3 in order to help spread the load of the jack 54 and to prevent damage to the platform 3.

The jack hydraulic pump and control apparatus 54 and hoses 56 are joined to the jacks 54. The apparatus 1 is then in the position and configuration generally shown in FIG. 5 and the tower 2 is effectively ready to be raised. At this time the nuts 30 securing each of the tower feet 14 to the platform 3 are loosened, such as is shown by the loosened nut 30 and associated wrench 130 in FIG. 4. Normally, the nut 30 will not be entirely removed from an associated rod 27, but will simply be loosened one to several inches. The guy wires 38 may also be loosened slightly by operation of the turn buckles 42, if slack must be placed in them to allow slight raising of the tower 2.

At this point the hydraulic pump and control apparatus 55 is operated to carefully pressurize the hoses 56 and, consequently, the jacks 54 to raise the jack pistons 60 in a simultaneous manner and in a carefully controlled manner so that the pistons 60 bias against the clamps 47 associated therewith and produce vertical movement of the clamps 47. As the clamps 47 are attached to associated legs 10 of the tower 2, the tower 2 is also raised vertically a like distance. Normally the tower 2 will be raised about one to two inches which will be sufficient to remove the old protective pad 33, if any, and insert a new protective pad 110. The new pad 110 will have a notch 111 cut therein to allow it to slide over the rod 27. Prior to placement of the new pad 110 beneath the foot 14, loose debris is typically also removed from beneath the foot 14. Once the new pad 110 is in place, a plug 112 is inserted to fill the opening left by the notch 111 which is not filled by the rod 27. This procedure is shown in FIG. 7. A suitable pad 110 is constructed of rubberized cloth or the like and one such pad is sold by Fabreeka International, Inc.

Once the new pad 110 is in place the above operation is reversed. That is hydraulic pressure is removed from the jacks 54 so the pistons 60 retract and the tower 2 is lowered so as to be again supported by the platform 3 and the new pads 110. The nuts 30 are again tightened, as are the turn buckles 42. The tower lifting apparatus 1 is then removed from the tower 2.

It is to be understood that while certain forms of the present invention have been illustrated and described herein, it is not to be limited to the specific forms or arrangement of parts described and shown.

What is claimed and desired to be secured by Letters Patent is as follows:

1. A tower lifting apparatus comprises:

a) clamping means for frictionally clamping to at least one V-shaped leg of a tower; said clamping means including first structural means having a first tower leg engaging surface that is V-shaped for nestingly receiving an outer side of the tower leg and second structural means having a second tower leg engaging surface that is V-shaped for snugly being receiving against an inner side of the tower leg;

b) jacking means for operably engaging said clamping means and consequently moving said clamping means and said tower between vertical positions thereof; and c) control means for controlling the amount of movement of said jacking means.

2. A tower lifting apparatus for lifting a tower having multiple legs comprising:

a) a plurality of clamps; at least one of said clamps operably frictionally engaging a respective tower leg; each of said clamps including first structural means having a first tower leg engaging surface that is V-shaped for nestingly receiving an outer side of a respective tower leg and second structural means having a second tower leg engaging surface that is V-shaped for snugly being received against an inner side of the respective tower leg;

b) a hydraulic jack for operably engaging and motivating each of said clamps between raised and lower portions thereof when said clamps are in engagement with the tower legs so as to be adapted to raise and lower the tower; and c) a hydraulic fluid control system connected to and selectively operating said jacks.

3. The apparatus according to claim 2 including:

a) at least one cross brace operably connecting a pair of said clamps to prevent lateral movement of the clamps of said pair relative to each other during tower lifting.

4. The apparatus according to claim 2 wherein each of said clamps includes:

a) a backing plate and at least one strap adapted to snugly receive an associated tower leg therebetween.

5. The apparatus according to claim 4 wherein:

a) said backing plate includes first structural means thereon sized and shaped for nestingly receiving the outer side of a tower leg; and b) each of said straps include second structural means thereon sized and shaped to be snugly received within the inner side of a tower leg.

6. The apparatus according to claim 5 wherein:

a) said strap structural means include a truncated lug adapted to snug against a V-shaped inner side of a respective tower leg.

7. The apparatus according to claim 4 wherein:

a) said backing plate includes a lower jack engaging surface that is horizontally oriented during use.

8. The apparatus according to claim 7 wherein said backing plate includes:

a) a channel having upper and lower flanges;

b) a lower support member attached near the bottom of said channel and extending horizontally during use and further having said jack engaging surface thereon;

c) a vertically extending support member extending along and attached to a tower facing side of said channel;

d) an upper and a lower V-shaped member attached at a vertex thereof to said vertically extending support member and having V-shaped tower leg engaging surfaces thereon; and e) a gusset attached to said channel opposite said tower facing side and to said lower support member to reinforce said lower support member.

9. A tower lifting apparatus for a tower having a plurality of legs comprising;

a) a clamp for each leg of the tower; each of said clamps for being frictionally connected to a leg of the tower during a lifting operation; each of said clamps comprising:

1) a backing plate having a channel having a central web that is vertically oriented during use and having upper and lower flanges;

2) said backing plate further having an upper and a lower support member attached to said channel at opposite flanges thereof and extending generally horizontally during use; said lower support member having a lower jack engaging surface that is generally horizontally positioned during use;

3) a gusset being fixedly attached to a rear side of said channel opposite a tower facing side of said channel and also being attached to said lower support member so as to provide reinforcement to said lower support member;

4) a vertically extending member being attached to said channel at opposite ends thereof to said flanges of said channel and along a tower facing side of said channel;

5) a pair of V-shaped members, each having an apex and an inner V-shaped surface; said V-shaped inner surface sized and shaped to nestingly receive an outer surface of a tower leg during usage; said apexes being fixed to said vertical member;

6) each of said lower and upper support members having a tower leg engaging end sized and shaped to snugly receive a leg of the tower during usage;

b) at least one strap; said strap being joined to said backing plate during usage by bolt means so as to frictionally capture and engage said tower leg between said backing plate and said strap; said strap including thereon a truncated lug adapted to be received within an inner V-shaped portion of a leg of a tower during usage so as to snugly and frictionally engage the leg of the tower;

c) a cross brace connecting a pair of said clamps on adjacent tower legs during usage so as to prevent lateral movement of said clamps relative to one another;

d) hydraulic jack means operably located so as to engage said jack engaging surface of each clamp during usage;

e) a jack hydraulic pressure producing and controlling system for operably allowing selective control of said jack means so as to bias said jack means against said clamps and to thereby operably raise and lower said clamps along with a tower associated therewith.

10. A tower lifting apparatus for lifting having multiple legs comprising:

a) a plurality of clamps; at least one of said clamps operably frictionally engaging a respective tower leg;

b) a hydraulic jack for operably engaging and motivating each of said clamps between raised and lowered portions thereof when said clamps are in engagement with the tower legs so as to be adapted to raise and lower the tower;

c) a hydraulic fluid control system connected to and selectively operating said jacks; and d) at least one cross brace operably connecting a pair of said clamps to prevent lateral movement of the clamps of said pair relative to each other during tower lifting.

11. A tower lifting apparatus for lifting a tower having multiple legs comprising:

a) a plurality of clamps; at least one of said clamps operably frictionally engaging a respective tower leg;

b) a hydraulic jack for operably engaging and motivating each of said clamps between raised and lowered portions thereof when said clamps are in engagement with the tower legs so as to be adapted to raise and lower the tower;

c) a hydraulic fluid control system connected to and selectively operating said jacks;

d) a backing plate and at least one strap adapted to snugly receive an associated tower leg therebetween;

e) said backing plate includes first structural means thereon sized and shaped for nestingly receiving the outer side of a tower leg;

f) each of said straps include second structural means thereon sized and shaped to be snugly received within the inner side of a tower leg; and g) said strap structural means include a truncated lug adapted to snug against a V-shaped inner side of a respective tower leg;

12. A tower lifting apparatus for lifting a tower having multiple legs comprising:

a) a plurality of clamps; at least one of said clamps operably frictionally engaging a respective tower leg;

b) a hydraulic jack for operably engaging and motivating each of said clamps between raised and lowered portions thereof when said clamps are in engagement with the tower legs so as to be adapted to raise and lower the tower;

c) a hydraulic fluid control system connected to and selectively operating said jacks;

d) a backing plate and at least one strap adapted to snugly receive an associated tower leg therebetween;

e) said backing plate includes a lower jack engaging surface that is horizontally oriented during use;

f) a channel having upper and lower flanges;

g) a lower support member attached near the bottom of said channel and extending horizontally during use and further having said jack engaging surface thereon;

h) a vertically extending support member extending along and attached to a tower facing side of said channel;

i) an upper and a lower V-shaped member attached at a vertex thereof to said vertically extending support member and having V-shaped tower leg engaging surfaces thereon; and j) a gusset attached to said channel opposite said tower facing side and to said lower support member to reinforce said lower support member.

* * * * *